US011147338B2

(12) United States Patent
Fougere

(10) Patent No.: US 11,147,338 B2
(45) Date of Patent: Oct. 19, 2021

(54) SKI BOOT AND STRAP COMBINATION PROVIDING ENHANCED LATERAL PERFORMANCE

(71) Applicant: Raymond D. Fougere, Tiverton, RI (US)

(72) Inventor: Raymond D. Fougere, Tiverton, RI (US)

( * ) Notice: Subject to any disclaimer, the term of this patent is extended or adjusted under 35 U.S.C. 154(b) by 0 days.

(21) Appl. No.: 16/148,121

(22) Filed: Oct. 1, 2018

(65) Prior Publication Data

US 2019/0133244 A1 May 9, 2019

Related U.S. Application Data

(63) Continuation of application No. 15/042,812, filed on Feb. 12, 2016, now Pat. No. 10,085,512.

(60) Provisional application No. 62/146,120, filed on Apr. 10, 2015.

(51) Int. Cl.

| | |
|---|---|
| ***A43B 5/04*** | (2006.01) |
| ***A43C 11/14*** | (2006.01) |
| ***A43B 23/02*** | (2006.01) |
| ***A43C 11/16*** | (2006.01) |

(52) U.S. Cl.

CPC ..... *A43B 5/04* (2013.01); *A43B 5/046* (2013.01); *A43B 5/0415* (2013.01); *A43B 5/0427* (2013.01); *A43B 23/02* (2013.01); *A43B 23/0245* (2013.01); *A43C 11/1493* (2013.01); *A43C 11/165* (2013.01)

(58) Field of Classification Search

CPC ... A43B 5/0415; A43B 5/0409; A43B 5/0429; A43B 5/0433; A43C 11/002; A43C 11/004; A43C 11/006; A43C 11/1493; A43C 11/165; A43C 11/14; A43C 11/00; A43C 7/02

USPC ..... 36/117.9, 118.1, 50.5; D2/943, 946, 904, D2/973

See application file for complete search history.

(56) References Cited

U.S. PATENT DOCUMENTS

| | | | |
|---|---|---|---|
| 1,256,444 | A | 2/1918 | Derritt |
| 2,346,416 | A | 4/1944 | Clein |
| 2,596,112 | A | 5/1952 | Aines |
| 4,447,968 | A | 5/1984 | Spademan |

(Continued)

FOREIGN PATENT DOCUMENTS

| | | | |
|---|---|---|---|
| EP | 0642747 A1 | 3/1995 | |
| EP | 2494880 A1 * | 9/2012 | ..... A43B 5/0433 |

(Continued)

OTHER PUBLICATIONS

Translation of EP 2494880, Simonetti, Luigi, May 5, 2012 (Year: 2012).*

(Continued)

*Primary Examiner* — Heather Mangine

(74) *Attorney, Agent, or Firm* — Larson & Anderson, LLC

(57) ABSTRACT

A combination of a ski boot and a strap where the strap extends from an attachment point on the lateral side of a hard outer shell of the boot and in use is tightened to hold the inner boot liner in relatively fixed proximity to the lateral side of the outer boot shell during skiing. The strap can extend around the inner boot liner, or be at least partially incorporated as a part of the inner boot liner. In either case, the strap is adjustable between the tightened position, and an open position.

18 Claims, 7 Drawing Sheets

(56) References Cited

U.S. PATENT DOCUMENTS

| | | | | |
|---|---|---|---|---|
| 4,928,405 | A | 5/1990 | Spademan | |
| 5,007,186 | A | 4/1991 | Bischof et al. | |
| 5,123,182 | A | 6/1992 | Hilgarth | |
| 5,214,805 | A | 6/1993 | Cochran | |
| 5,483,704 | A | 1/1996 | Filipiak | |
| 5,499,461 | A | 3/1996 | Danezin et al. | |
| D375,772 | S | 11/1996 | Riggs et al. | |
| 5,606,808 | A | 3/1997 | Gilliard et al. | |
| 5,692,321 | A | 12/1997 | Holstine | |
| 5,718,067 | A | 2/1998 | Ostinet et al. | |
| 5,778,563 | A | 7/1998 | Ahlbaumer | |
| D401,037 | S | 11/1998 | Meibock et al. | |
| 5,937,542 | A * | 8/1999 | Bourdeau | A43B 5/0405 36/10 |
| 5,943,793 | A | 8/1999 | Clements | |
| 6,026,594 | A | 2/2000 | Fougere | |
| 6,101,744 | A | 8/2000 | Gallon | |
| 6,393,619 | B1 | 5/2002 | Bardes | |
| 6,474,004 | B2 | 11/2002 | Collavo | |
| 6,477,744 | B1 | 11/2002 | Miles | |
| 6,539,648 | B1 | 4/2003 | Collavo | |
| 7,946,061 | B2 | 5/2011 | Holzer et al. | |
| D659,376 | S | 5/2012 | John | |
| 8,359,771 | B2 | 1/2013 | Holzer et al. | |
| 8,443,464 | B2 | 5/2013 | Schumacher | |
| 8,505,170 | B1 | 8/2013 | Gray et al. | |
| 2003/0041480 | A1 | 3/2003 | Bruce | |
| 2004/0211091 | A1 | 10/2004 | Heierling et al. | |
| 2005/0102860 | A1 | 5/2005 | Sartor et al. | |
| 2006/0080864 | A1 | 4/2006 | Chen et al. | |
| 2007/0074429 | A1 | 4/2007 | McKay | |
| 2007/0169378 | A1 | 7/2007 | Sodeberg et al. | |
| 2010/0299959 | A1 | 12/2010 | Hammerslag et al. | |
| 2012/0284965 | A1 | 11/2012 | Plekker et al. | |
| 2013/0283639 | A1 | 10/2013 | Williams et al. | |
| 2014/0358054 | A1 | 12/2014 | Capra et al. | |
| 2016/0255915 | A1 | 9/2016 | Dames-Coppe | |

FOREIGN PATENT DOCUMENTS

| | | | |
|---|---|---|---|
| EP | 2494880 | A1 | 9/2012 |
| FR | 2879411 | A1 | 6/2006 |
| WO | 2002094047 | A1 | 11/2002 |
| WO | 2007046160 | A1 | 4/2007 |

OTHER PUBLICATIONS

International Search Report dated Aug. 1, 2016 for related International Patent Application No. PCT/US2016/016973 filed on Feb. 8, 2016.

Merlinm: Salomon Mountain Lab 120, Internet blog—Skipass, Jan. 27, 2015, XP002757345, Retrieved from the Internet: URL: http://www.skipass.com/forums/sports/ski/sujet-133569.html on May 3, 2016.

* cited by examiner

SKI BOOT AND STRAP COMBINATION PROVIDING ENHANCED LATERAL PERFORMANCE

RELATED APPLICATIONS

This application claims the benefit of U.S. Provisional Application No. 62/146,120 filed Apr. 10, 2015, which is incorporated herein by reference in its entirety.

FIELD OF THE INVENTION

This application relates to a combination of a ski boot and a strap to provide enhanced lateral performance while skiing, and to a kit for retrofitting an existing ski boot to convert it into a boot useable in the combination of the invention.

BACKGROUND OF THE INVENTION

Modern ski boots all include a soft, compressible inner boot liner enclosed in a hard outer shell. During skiing, the sole of the ski boot is rigidly connected to the ski by a ski binding. As a result, the ski boot acts as an interface between the ski and the lower leg of the skier. The skier exerts control over the ski by movement of the skier's leg, and this movement is transmitted to the ski though the boot. This movement can be separated into two components, movement in the forward/backward direction, and side-to-side or lateral movement. The lateral motion (tipping the ski) places the ski on its edge and allows the creation of a banked platform in the snow on which the ski can take a curved path, similar to a banked turn on a roller coaster.

Modern skiing and especially ski racing requires the skier to have excellent fore/aft balance during the turning of the ski. The construction of the ski boot plays a key role in allowing the skier or ski racer to maintain such balance. Forward pressure is applied to the front of the ski through the ski boot and bends the front of the ski more than the back. Various approaches have been described to optimize this aspect of the leg-to-ski boot interface.

One example found in many ski boots is a non-elastic "power strap" which secures the boot to the lower leg of the wearer by use of a conventional hook and loop (VELCRO®) closure. Such strap is shown in U.S. Pat. No. 5,718,067.

U.S. Pat. No. 6,026,594 provides an improvement on the power strap concept, by incorporating an elastic portion into the strap. This allows the strap to apply a relatively constant pressure to the lower leg of the wearer as the boot is flexed and relaxed.

U.S. Pat. Nos. 7,946,061 and 8,359,771 disclose a variation on the concept of U.S. Pat. No. 6,026,594 in which a non-elastic strap is supported on or connected to an elastic element that is attached to the boot.

These efforts to modify ski boots to enhance the interface between the leg of the skier and the ski have all focused on improved transmission of the forward/backward movement of the skier's leg. This forward/backward aspect is of significant importance for good skiers and especially racers, but may be of less importance to novice and recreational skiers who do not generate the same amount of movement in this direction as part of their turning movement.

The present invention focuses on enhancing the efficiency with which lateral movement of the skier's leg is transmitted to the ski.

SUMMARY OF THE INVENTION

In accordance with the present invention, a combination of a ski boot and a strap is provided. The ski boot has a compressible inner boot liner enclosed in a hard outer shell. The strap extends from an attachment point on the lateral side of the hard outer shell of the boot and in use is tightened to hold the inner boot liner in relatively fixed proximity to the lateral side of the outer boot shell during skiing. The strap can extend around the inner boot liner, or be at least partially incorporated as part of the inner boot liner. In either case, the strap is adjustable between the tightened position, and an open position. The open position may be one in which the diameter of a loop surrounding or incorporated in the inner boot liner is increased to allow entry of the users foot into the boot. Alternatively, the open position may be a position in which two ends of the strap remote from the attachment point are free and separated (for example, unbuckled) from one another, with the attachment located between the ends.

The attachment point for the strap can be defined during manufacture of a ski boot. On the other hand, for providing the strap to boots without this feature, a further aspect of the invention provides a kit comprising a strap and a attachment fixture.

DETAILED DESCRIPTION OF THE INVENTION

The present application provides an improvement to ski boots to provide enhanced lateral performance while skiing. The use of the combination of a ski boot and strap that holds the compressible inner liner in a relatively fixed position proximate to the lateral surface of the hard outer shell provides more responsive angulation of the ski, thus enhancing the turning performance of the ski. This enhancement is particularly noticeable on icy surfaces.

Definitions

In the present application, the following terms are used.

Figure 5:
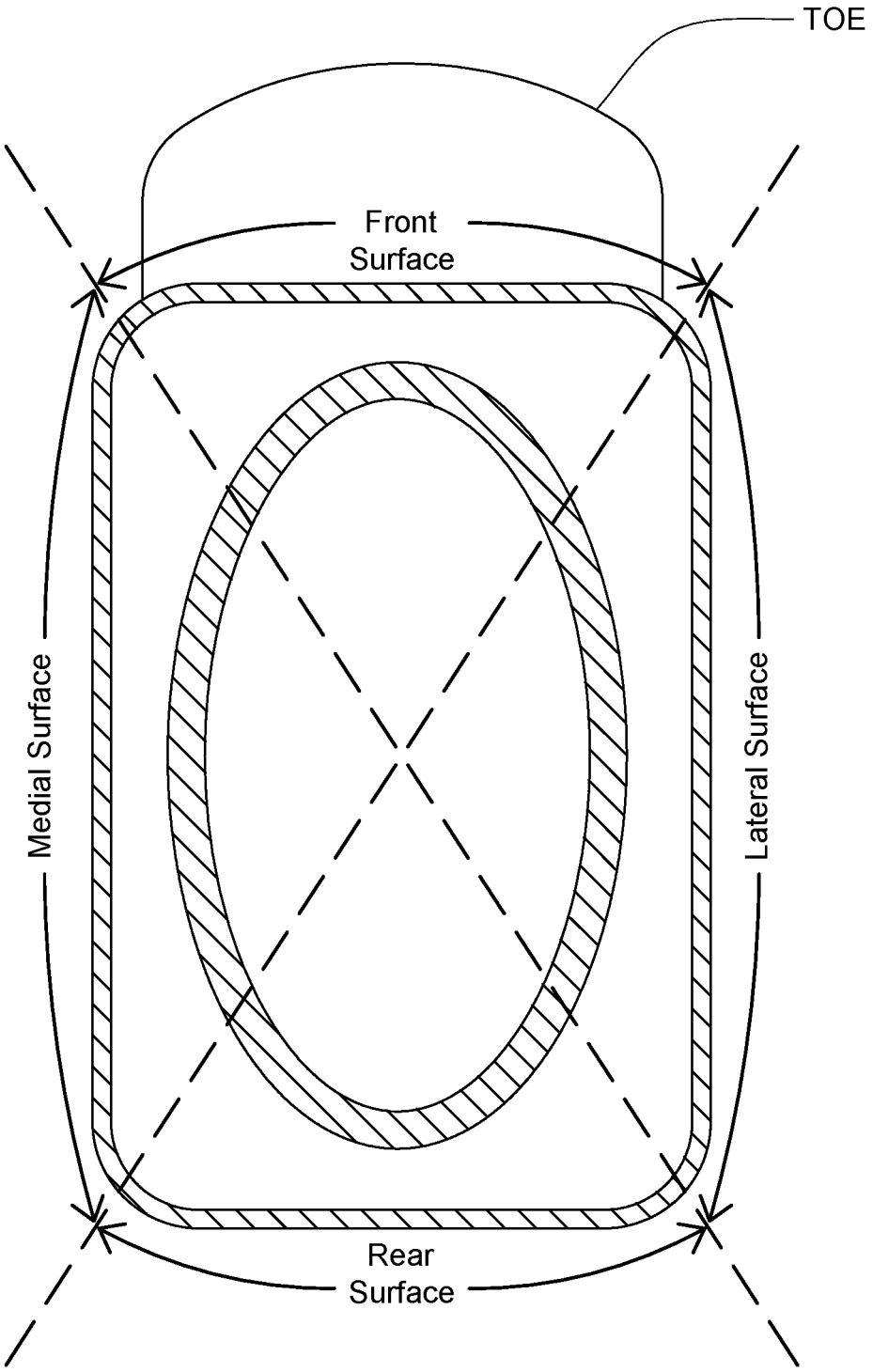
FIG. 5 shows a top view of a boot and defines the lateral, medial, front and rear surface.

The term "lateral" when used in the context of the movement of the user's leg and the boot refers to a motion in the side-to-side direction. The term "lateral" when used in the context of the structure of the boot refers to the part of the boot away from the center line of the body of the user. The opposite part of the boot is referred to as the "medial" surface. The lateral surface encompasses an arc-angle of 90 degrees when the ski boot is viewed from the top, as shown in FIG. 5. The term "lateral surface" encompasses both the inside and the outside of the boot structures within this arc-angle.

The term "strap" refers to a strap that is separate from the compressible inner liner of a ski boot and surrounds it in a loop when in use, or to a portion of the compressible inner liner that can be drawn to a relatively fixed position proximate to the lateral surface of the boot, or to a combination thereof. When the strap is part of the compressible inner liner, it may be a reinforcing strap of fabric or metal cables that is incorporated into the compressible inner liner. In either embodiment, the strap may be a static, non-elastic strap, or may incorporate elastic portions, for example as described in U.S. Pat. No. 6,026,594, which is incorporated herein by reference.

The term "attachment point" refers to a fixture, structure or fitting at which the strap is affixed to the hard outer shell of the ski boot to hold the compressible inner liner in a relatively fixed position proximate the lateral surface of the hard outer shell. "Affixed" means that the strap is held in a defined location by the fixture, structure or fitting during skiing, and the fixation may be on the interior or the exterior surface of the hard outer shell. The strap need not be permanently affixed to the hard outer shell of the ski boot. The attachment point may incorporate a variety of features as discussed below, and may include an elastic portion to which the strap is attached, for example as described in U.S. Pat. Nos. 7,946,061 and 8,359,771 which are incorporated herein by reference.

The attachment point may be centered on the lateral surface of the ski boot, i.e at the center of the 90 degree arc-angle, or may be disposed in front of or behind the center point of the lateral surface (45 degree forward or 45 degrees back). In some embodiments, the attachment point is disposed within the central 60 degrees of arc-angle with respect to the center point (30 degrees forward or 30 degrees back from the center point). It will be appreciated that the attachment point is of finite dimensions and therefore occupies more than a single point on the hard outer shell. The position of attachment point is determined based on the front-to-back center of whatever fixture, structure or fitting is used.

The term "relatively fixed position proximate to the lateral surface of the ski boot" refers to the position in which the inner boot liner is held during use. The position is not "absolutely fixed" since there may be some give in the strap, even if elastic material is not incorporated in the strap or attachment point. The degree of fixation is therefore one such that movement relative to the lateral surface of the boot can only occur in the tightened position in response to the application of lateral force during a skiing maneuver. The term "proximate" means that the compressible inner liner is held against the inner surface of the lateral surface of the boot at the attachment point, subject to any space needed for intervening hardware.

DESCRIPTION OF SPECIFIC EMBODIMENTS

Figure 1:
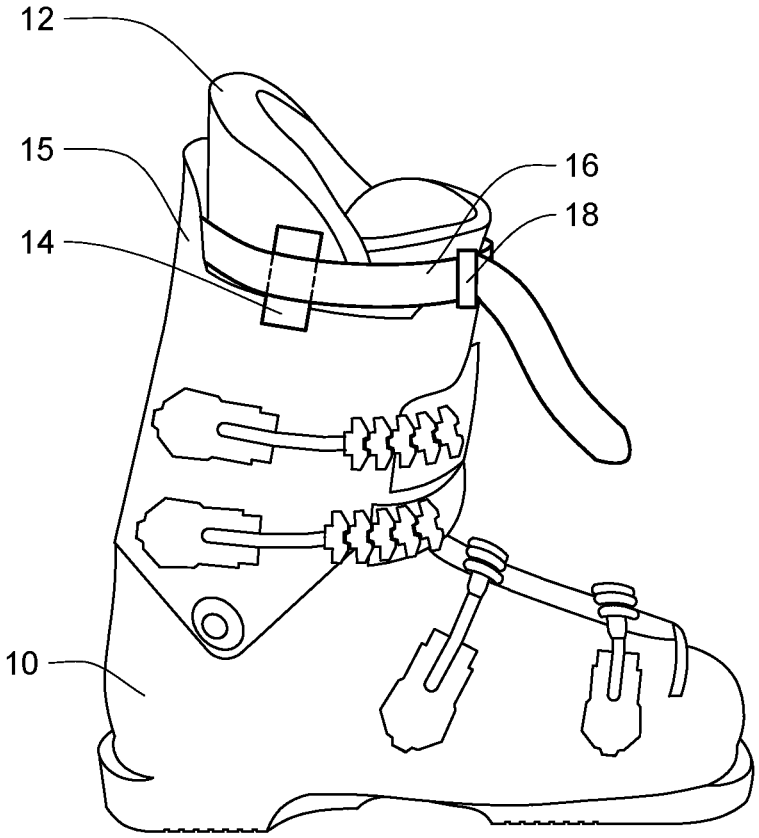
FIG. 1 shows a lateral view of a boot and strap combination in accordance with the invention.

FIG. 1 shows a lateral view of a boot and strap combination in accordance with an embodiment of the invention. The boot comprises a hard outer shell 10 and a compressible inner boot 12. A tab 14 is affixed to and extends upwards from the upper edge of the hard outer shell 10 and serves as the attachment point in this embodiment of the invention. Strap 16 is position against tab 14 and passes around the inner boot 12. Buckle 18 allows the strap to be held in a tightened position.

Figure 2:
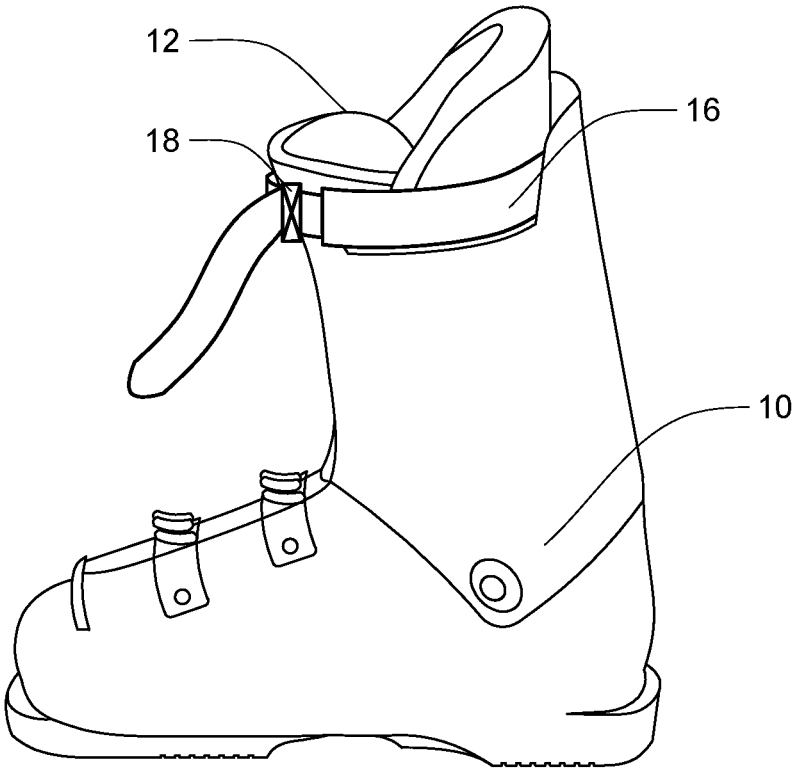
FIG. 2 shows a medial view of the boot and strap combination of FIG. 1.

FIG. 2 shows a medial view of the boot and strap combination of FIG. 1. As can be seen, the strap 16 is tightened around the inner boot 12, and does not overlap the rear or medial sides of the hard outer shell 10.

The tab 14 can be made of metal, and affixed to the hard outer shell 10, for example using a screw or rivet, on either the inside or outside the hard outer shell. The tab 14 can also be a separate piece that fits into a molded slot in either the interior or exterior of the hard outer shell 10. The tab 14 can also be a molded extension of the hard outer shell 10. In this case, the tab may include ridges or other structures to enhance it stiffness and resistance to deformation by the pressure of the tightened strap. The tab 14 may also be formed as an extension of the high back 15 of the hard outer shell 10 in which case the strap would be attached on the inner surface of the extension.

FIGS. 1 and 2 together illustrate the basic concept of the invention, but the nature of the strap and the attachment point can be varied without departing from the invention.

Figure 3A:
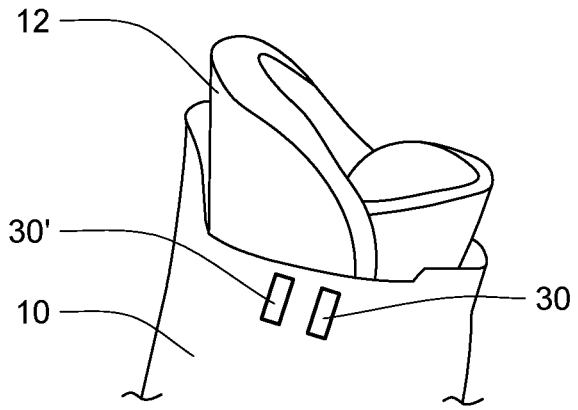
FIGS. 3A-C show detailed views of an attachment point in which slots for receiving the strap are molded in the hard outer shell 10 of the boot.
Figure 3B:
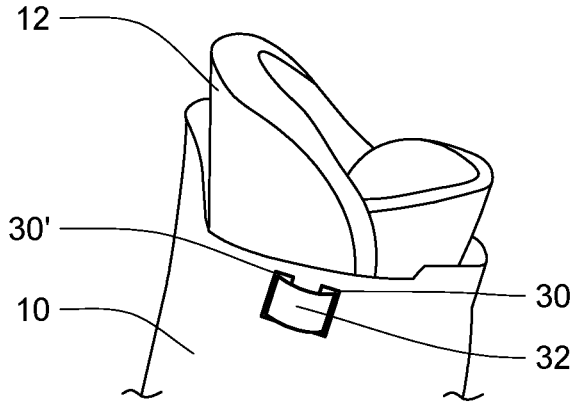
Figure 3C:
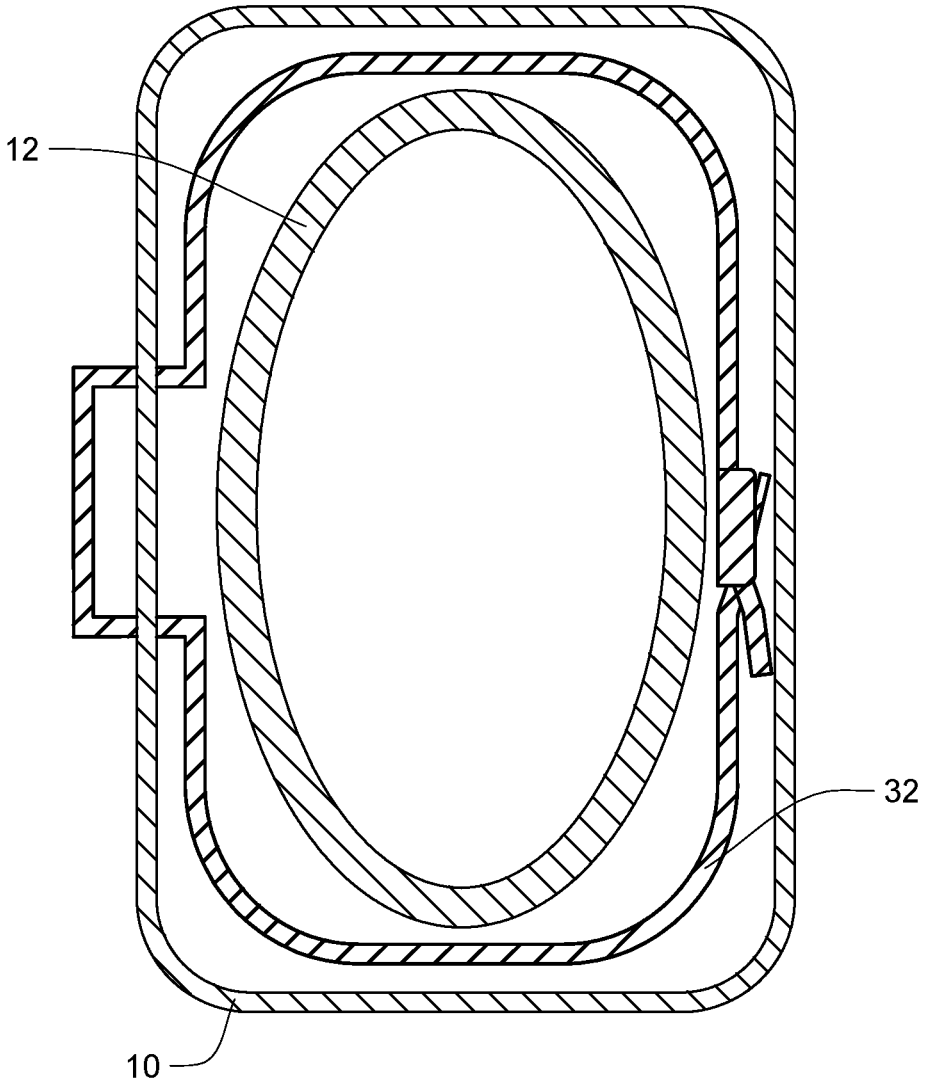
Figure 6:
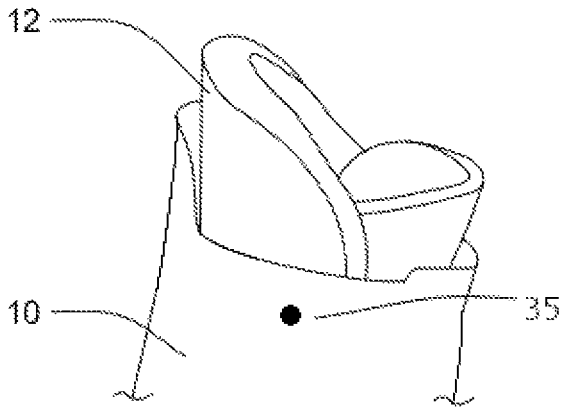
FIG. 6 shows an attachment point in which a fastener affixes the strap to the hard outer shell of the boot.

FIGS. 3A-C show detailed views of an attachment point in which slots for receiving the strap are molded in the hard outer shell 10 of the boot. The two slots 30 and 30' are molded as openings near the top of the hard outer shell 10 and sized to receive a strap 32 (as shown in FIG. 3B). FIG. 3C shows a top view in which the strap 32 is shown passing from the slots and around the inner boot 12 on the inside of the hard outer shell 10. In place of the slot which allows the strap to be easily changed, the strap could be affixed to the hard outer shell, as shown in FIG. 6, by a fastener 35 passing through the strap and the hard outer shell. Preferred fasteners include rivets, and binding screws and posts that provide a smooth finish on both the interior and exterior surfaces.

Figure 4A:
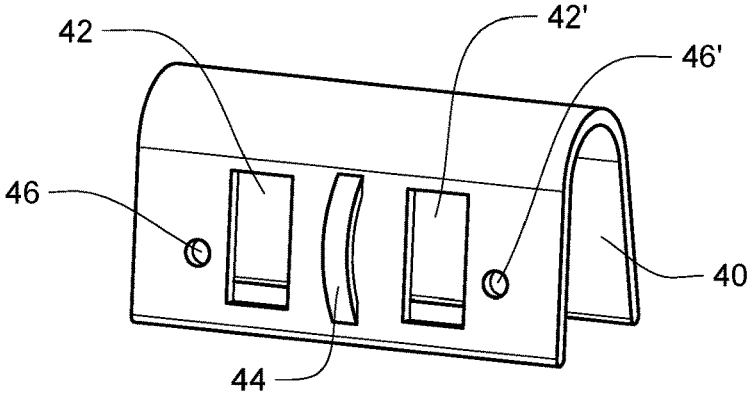
FIGS. 4A, B and C show fittings for receiving a strap that fits over the top edge of the hard outer shell of the boot.
Figure 4B:
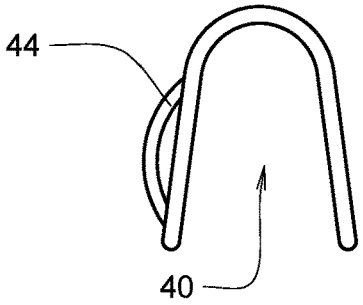

FIGS. 4A and B show a fitting for receiving a strap that fits over the top edge of the hard outer shell of the boot. The fitting is a generally U-shaped form having an central groove 40 that fits over the top edge of the hard outer shell of the boot. On one or both faces of the fitting there are slots 42, 42' cut to receive the strap. The region 44 between the slots 42, 42' can be flat, in which case the strap is suitably introduced before the fitting is attached to the boot, or it can be bowed outwards, as shown in FIG. 4B so that the strap can be inserted or changed after the fitting in on the boot. The size of the slot 40 may be such that simply pressing it onto the edge of the boot is sufficient to hold the fitting in place (friction fit), or it can be attached using fasteners, for example through holes 46, 46'. The fitting might also be glued into position.

Figure 4C:
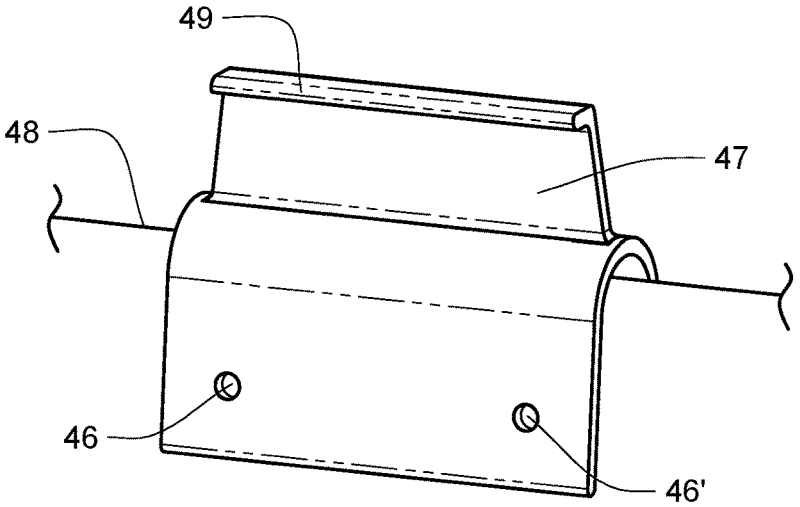

FIG. 4C shows an alternative embodiment of a fitting for receiving a strap that fits over the top edge 48 of the hard outer shell of the boot. In this fitting, the fitting has two holes 46,46' for fasteners to affix the fitting to the boot and a tab 47 extending upwards from the fitting although a friction fit or glue can be used in this instance as well. The tab 47 suitably has a thickened top edge 49 which provides a lip to keep the strap from slipping off of the tab 47 when the strap is tightened, but otherwise does not have a specific engagement with the strap.

As an alternative to the fitting shown in FIGS. 4 A-C, a comparable result is obtained with a fitting that is affixed with fasteners or glue to one surface of the top edge of the hard outer shell of the ski boot.

As an alternative to the use of a strap having two discrete, free ends, which are affixed together to form a loop when in use, the strap may be provided in the form of a closed loop that either surrounds the compressible inner liner or is part of the compressible inner liner. In some embodiments, this strap is tightened using a reel and a steel lace cable system, known commercially as BOA® technology, as described generally in U.S. Patent Publications Nos. 2014/0358054 and 2007/0169378 which are incorporated herein by reference. In such embodiments, the control mechanism for the reel, for example a knob, is generally located on the exterior of the lateral surface of the hard shell of the boot, with the cables passing through an opening in the hard outer shell. Turning the knob tightens the cables and draws the compressible inner liner into the relatively fixed position proximate the interior surface of the lateral side of the hard shell of the boot. The vertical position of the knob and the associated attachment point is not critical provided that it is above the ankle, and may be near the top of the hard outer shell, or lower down, for example between the top two buckles of the boot.

The strap and boot combination of the present invention can be used independent of or in combination with a front to back "power strap" or other type system to enhance the performance in the front-to-back direction of movement. In addition, combinations of the strap/boot configurations can be used. For example, a separate strap can be employed near the top of the boot, together with an incorporated strap lower down on the boot.

The various features of the strap and attachment point as described above can be used in any combinations to provide the benefits of the invention.

The features of the strap and attachment point can also be embodied I a kits for adapting a pair of ski boots each having a hard outer shell and a compressible inner liner for enhanced lateral performance. Such a kit comprises:

(a) a pair of straps; and (b) a pair of fittings, said fittings providing an attachment point for the straps to the ski boots when the fittings are affixed to the ski boot at the top edge of the lateral surface of the hard outer shells. The kit may also include fasteners for attachment of the fittings, and a pattern, where appropriate, to define the location of holes to be drilled in the boot liner.

In some embodiments of the kit, the fitting has slots cut therein, said slots being sized to allow the strap to be passed through the slots to associate it with the ski boot.

In some embodiments of the kit, the fitting is a U-shaped structure with a central groove sized to receive the top edge of the hard outer shell of the ski boot within the central groove.

In some embodiments of the kit, the straps each include a non-elastic component and an elastic component.

The invention claimed is:

1. A ski boot configured to enhance lateral performance while skiing, the ski boot having a plane extending longitudinally from a rear end of the ski boot to a toe end of the ski boot, the plane bisecting the ski boot into a lateral side and a medial side, the ski boot comprising:

a hard outer boot shell;

a single attachment point disposed entirely on the lateral side of the hard outer shell;

a compressible inner liner configured to fit within the hard outer boot shell; and a strap coupled to the single attachment point and directly contacting and extending circumferentially around an outer surface of the compressible inner liner without overlapping the rear or medial sides of the hard outer shell, said strap being configured to secure the compressible inner liner to the lateral side of the ski boot when said strap is secured.

2. The ski boot of claim 1, wherein the strap has two free ends and is configured to be connected with the single attachment point at a location between the free ends, wherein the strap further comprises a closure configured to maintain the strap in a tightened position.

3. The ski boot of claim 2, wherein the closure is a buckle.

4. The ski boot of claim 2, wherein the closure is a hook and loop closure.

5. The ski boot of claim 2, wherein the closure is configured to be positioned between the hard outer boot shell and the compressible inner liner.

6. The ski boot of claim 5, wherein the closure is configured to be positioned on a side of the boot opposite the single attachment point.

7. The ski boot of claim 1, wherein at least a portion of the strap is elastic.

8. The ski boot of claim 1, wherein the strap includes a non-elastic component and an elastic component, said elastic component providing a restorative force to maintain the inner boot against the lateral side of the outer boot shell during movements associated with skiing.

9. The ski boot of claim 1, wherein the strap is non-elastic.

10. The ski boot of claim 1, wherein the strap is affixed to the single attachment point via a fastener that passes through the strap and the outer boot shell.

11. The ski boot of claim 10, wherein the fastener comprises a rivet connecting the strap with the hard outer shell.

12. The ski boot of claim 10, wherein the fastener comprises a screw connecting the strap with the hard outer shell.

13. The ski boot of claim 1, wherein the single attachment point is configured to be detachably connected with the strap.

14. The ski boot of claim 1, wherein the single attachment point includes slots configured to receive the strap.

15. A combination comprising a ski boot and a strap, the combination comprising:

the ski boot comprising a compressible inner boot liner enclosed in a hard outer shell, and a plane extending longitudinally from a rear end of the outer boot shell to a toe end of the outer boot shell, the plane bisecting the outer boot shell into two sides;

a single attachment point disposed entirely on one of the two sides of the outer boot shell; and the strap, said strap being directly coupled to the single attachment point and directly contacting and extending circumferentially from said attachment point around an outer surface of the inner boot liner without overlapping the rear end of the outer boot shell or an other of the two sides of the hard outer shell, said strap being configured to secure the compressible inner liner to the side of the hard outer shell where the single attachment point is disposed, when said strap is secured.

16. The combination of claim 15, wherein the strap has two free ends and is configured to be connected with the single attachment point at a location between the free ends, wherein the combination further comprises a closure configured to maintain the strap in a tightened position.

17. The combination of claim 15, wherein the strap includes a non-elastic component and an elastic component, said elastic component providing a restorative force to maintain the inner boot against the one of the two sides of the hard outer boot shell, where the single attachment point is located, during movements associated with skiing.

18. The combination of claim 15, wherein the single attachment point comprises slots, and wherein the strap extends through the slots and around the outer surface of the inner boot liner.

* * * * *